United States Patent [19]

Brackmann et al.

[11] 4,287,897

[45] Sep. 8, 1981

[54] TREATMENT AND OPENING OF ORIENTAL TOBACCO BALES

[75] Inventors: Warren A. Brackmann, Cooksville; Albert Kuhner, Schomberg, both of Canada

[73] Assignee: Rothmans of Pall Mall Canada Limited, Don Mills, Canada

[21] Appl. No.: 78,963

[22] Filed: Sep. 26, 1979

[30] Foreign Application Priority Data

Oct. 3, 1978 [GB] United Kingdom ..... 39186/78

[51] Int. Cl.[3] ..... A24B 1/02

[52] U.S. Cl. ..... 131/303; 131/327

[58] Field of Search ..... 131/140, 134, 135, 136, 131/138, 145, 146, 133, 133 A, 149

[56] References Cited

U.S. PATENT DOCUMENTS

| | | | |
|---|---|---|---|
| 3,357,437 | 12/1967 | Maguire | 131/149 X |
| 3,662,990 | 5/1972 | Barnett et al. | 131/149 X |
| 3,898,996 | 8/1975 | Gartside et al. | 131/136 |

FOREIGN PATENT DOCUMENTS

| | | | |
|---|---|---|---|
| 467734 | 7/1973 | U.S.S.R. | 131/135 |

*Primary Examiner*—Stephen C. Pellegrino

*Attorney, Agent, or Firm*—Sim & McBurney

[57] ABSTRACT

Burlap-clad bales of turkish or other oriental small leaf tobacco are passed between two upright steam applicators each having a plurality of individual steam jet openings. The openings cause injection of steam through the outer burlap cover and penetration into the loosely packed bale along the grain of the bale. The outer burlap cover is then removed and the bale opened by placing the same on a vibrating conveyor.

2 Claims, No Drawings

TREATMENT AND OPENING OF ORIENTAL TOBACCO BALES

FIELD OF INVENTION

The present invention relates to the treatment of bales of oriental tobacco.

BACKGROUND TO THE INVENTION

Oriental tobacco, particularly turkish tobacco, is characterized by small leaf size (typically 6 inches long and 3 inches wide) and by being shipped in small burlap-wrapped bales, typically of about 50 lb. weight and having dimensions of 16 inches wide, 16 inches high and 12 inches deep. The leafs are loosely packed in layers in the bale, the layers extending across a minor dimension of the bale.

When said bales are opened, they are steam treated in an enclosed treatment unit to moisten the tobacco, the bales are cut in two, the burlap removed and the bale halves are broken up to separate bale leaves from each other in a rotating cylinder. This procedure does not moisten all the tobacco leaves sufficiently, so that large quantities of leaf fines are produced after break-up of the bale halves.

SUMMARY OF INVENTION

In accordance with the present invention, there is provided a method of moistening and opening bales of oriental tobacco which results in more overall moistening of tobacco and less tobacco degradation.

In this invention, an oriental tobacco bale is subjected to the action of steam jets injected into the opposite sides of the burlap-clad bales in alignment with the grain of the tobacco. By suitable adjustment to the steam pressure penetration of steam from opposite sides of the bale to the centre along the tobacco layers may be attained so that all the leaves in the bale are moistened.

DESCRIPTION OF PREFERRED EMBODIMENT

A preferred manner of effecting this procedure, which is the current best known mode of effecting the invention, now will be described. In this preferred embodiment, the burlap-wrapped oriental tobacco bale is positioned in an upright orientation so that the grain of the tobacco layers is vertical to the base on which the bale is sitting. Upright steam flow tubes or header pipes are provided in contact with the opposite vertical sides of the bale between which the grain extends. The steam flow tubes have closely-vertically-spaced steam jet openings through the bale-contacting height thereof for injection of steam jets directly into the burlap-clad bale. The steam flow tubes may be held against the adjacent bale surface in any convenient manner to ensure injection of steam from the jet openings directly into the bale.

Relative motion is provided between the bale and the steam flow tubes while steam is passed out of the jet openings and into the adjacent bale surface, so that steam is injected into the bale throughout the dimension of the sides. Preferably, the relative motion is achieved by moving the bale past the steam flow tubes which are held stationary.

The steam pressure is regulated to achieve penetration to the centre of the bale from both sides so as to ensure moistening of all the tobacco in the bale.

When the steam jets are arranged in a vertical line, as in the above-described preferred embodiment, it is preferred for the grain also to be oriented vertically as described, so as to ensure that each plane of tobacco leaves in the bale is contacted by the injected steam.

The grain, however, may be oriented horizontally, if desired, although this orientation may not ensure complete exposure of the tobacco to injected steam, depending on the vertical spacing of the steam jets.

Once the steam treatment is complete, the burlap wrapping is removed from the steam treated tobacco in any convenient manner, and the integrity of the bale thereafter is destroyed, such as, by placing the same on a vibrating conveyor.

The high incidence of leaf moistening which is achieved in the stream treatment operation of this invention leads to lesser tobacco degradation upon break up of the bale than is the case when the conventional procedure is used.

EXAMPLE

A burlap-wrapped bale of oriental tobacco of dimensions 16×16×12 inches and weighing about 50 lbs. was conveyed on a horizontal conveyor belt at a speed of about 10 ft/min. The bale was oriented so that the grain of the tobacco extended vertically and transverse of the conveyor belt. In this orientation, the 12-inch dimension also extended transverse of the conveyor belt.

The bale was conveyed between and in contact with two upright steam header pipes extending the height of the bale and having a plurality of closely-vertically-spaced openings delivering steam at a pressure of about 120 psig into the adjacent burlap-clad bale side.

When the bale had passed the header pipes, the burlap covering was removed and the bale was placed on a vibrating conveyor on which the bale readily broke up into a loose mass of moist warm tobacco leaves. Inspection of the leaves revealed them all to be moistened and no tobacco degradation to have occurred.

SUMMARY OF DISCLOSURE

The present invention, therefore, provides an improved procedure for the premoistening and opening of oriental tobacco bales. Modifications are possible within the scope of the invention.

What we claim is:

1. A method of premoistening and opening a burlap-wrapped bale of oriental tobacco, which comprises:

conveying said bale horizontally in a rectilinear direction with the grain of the tobacco in the bale oriented generally transversely of the direction of movement of the bale, injecting a vertically-aligned plurality of steam jets directly into each side of the burlap-clap bale over the vertical height thereof as said bale is conveyed therepast to cause penetration of steam into the centre of the bale, removing the burlap covering from the resulting steam-treated bale, and vibrating the coverless steam-treated bale to cause the bale to fall apart and lose its integrity.

2. The method of claim 1 wherein said tobacco grain is oriented vertically.

* * * * *